United States Patent [19]

Girard et al.

[11] Patent Number: 4,944,070

[45] Date of Patent: Jul. 31, 1990

[54] CONTINUOUS COTTON WET FINISHING

[75] Inventors: Lawrence Girard; E. Walter Meyer, both of Greenville, S.C.

[73] Assignee: Greenville Machinery Coropration, Greer, S.C.

[21] Appl. No.: 327,601

[22] Filed: Mar. 23, 1989

[51] Int. Cl.[5] ..... D06B 1/00; D06B 3/00

[52] U.S. Cl. ..... 19/66 CC; 19/66 R; 8/149.1

[58] Field of Search ..... 19/66 CC, 66 R, 305, 19/306; 68/355; 8/149.1; 28/107

[56] References Cited

U.S. PATENT DOCUMENTS

| | | | |
|---|---|---|---|
| 2,731,820 | 1/1956 | Burkardt et al. | 19/66 R |
| 2,972,220 | 2/1961 | Flack et al. | 19/66 R |
| 3,348,993 | 10/1967 | Sissons | 28/107 |
| 3,538,564 | 11/1970 | Skoler et al. | 28/107 |
| 3,802,838 | 4/1974 | De La Serviere | 19/66 R |
| 3,900,921 | 8/1975 | Zafiroglu | 19/306 |
| 4,213,218 | 7/1980 | Winch | 8/151 |
| 4,425,842 | 1/1984 | Winch et al. | 100/37 |
| 4,539,724 | 9/1985 | Kennedy et al. | 8/149.1 |
| 4,755,335 | 7/1988 | Ghorashi | 8/149.1 |

*Primary Examiner*—Werner H. Schroeder
*Assistant Examiner*—Michael A. Neas
*Attorney, Agent, or Firm*—Nixon & Vanderhye

[57] ABSTRACT

Cotton fibers are wet finished in a simpler and quicker manner by forming the loose cotton fibers into an integral batt by needling utilizing a needling machine, or air laying equipment. After formation of an integral batt having a weight in the range of 10–32 ounces per square yard, the cotton fibers in the integral batt form are fed to a wet finishing range for effecting scouring, bleaching, steaming, finish application, washing, and/or drying thereof. Subsequently, the finished integral batt will be passed to a conventional fiber opener to break it back into fibers, or it may be taken up into a package for further processing. 100% cotton fibers, or cotton blends having at least 60% cotton fibers, can be processed.

20 Claims, 1 Drawing Sheet

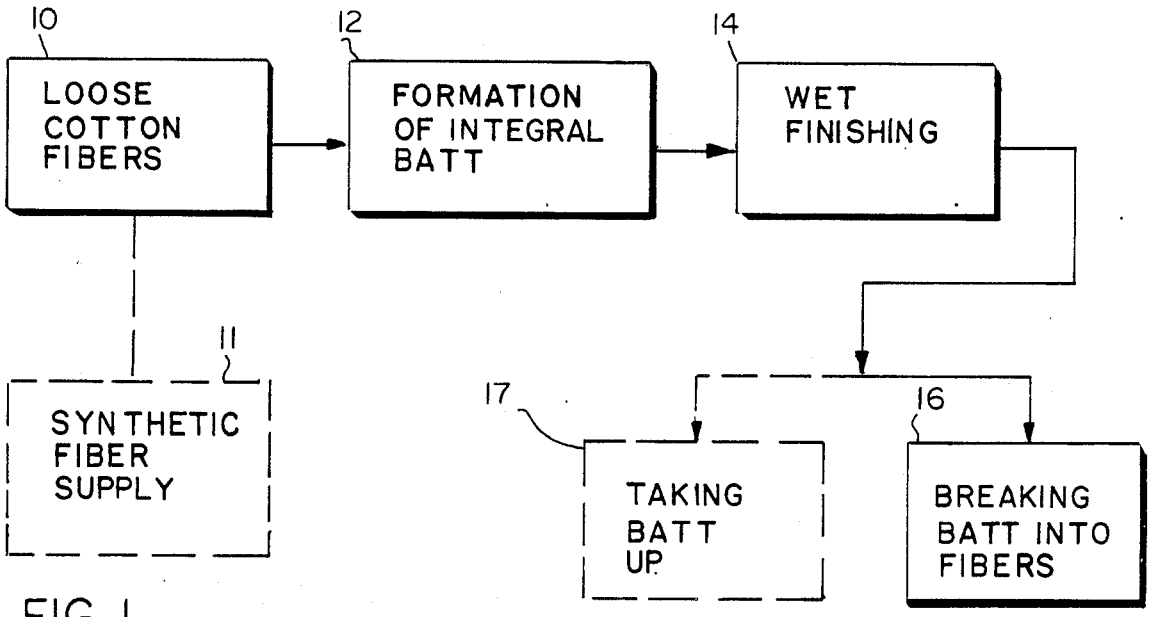
FIG. 1
FIG. 2
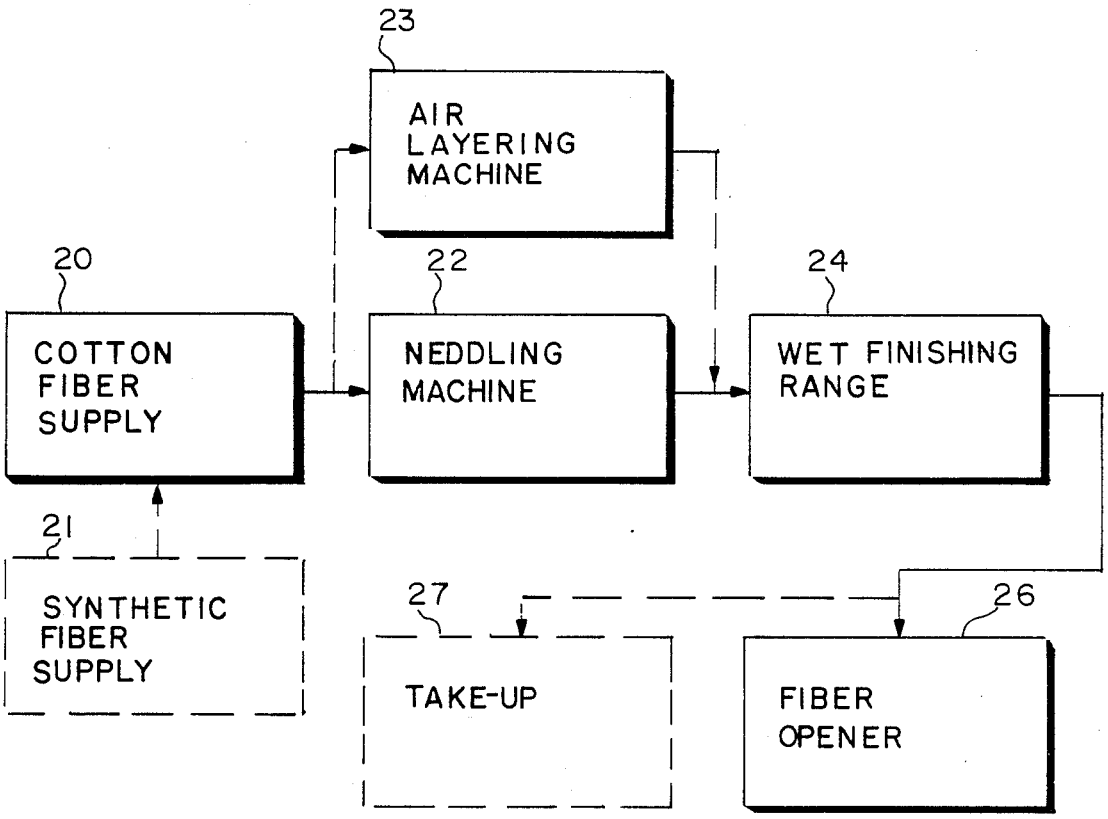

CONTINUOUS COTTON WET FINISHING

BACKGROUND AND SUMMARY OF THE INVENTION

Cotton has been found to be very desirable for the production of a number of different products. In fact cotton product demand is increasing worldwide. The utilization of conventional cotton processing equipment makes it difficult to keep up with the demand since the equipment is relatively expensive, slow, and difficult.

As illustrated in U.S. Pat. Nos. 4,425,842 and 4,213,218, for example, cotton is handled during the entire wet finishing process in a loose batt form. Since the cotton is subjected to scouring, bleaching, finish application, drying, washing, and steaming operations during wet finishing, it is necessary that the handling equipment utilize special types of conveyors, nips, mechanical transfer devices, flow controls, and chemicals during wet finishing, as shown in these patents. This necessitates a relatively slow line speed, and there can be problems in uniform side to side bleaching of the cotton fibers.

According to the present invention, it is possible to effect wet finishing of cotton fibers (or cotton blends) at increased line speed, and utilizing equipment that need not be specialized for the handling of loose cotton fibers batts. According to the present invention, the loose cotton fibers are formed into an integral batt which has sufficient integrity to withstand further wet processing, yet remains easily transformed back into loose fibers. The integral batt is preferably formed utilizing a needling machine, which can be operated at a speed of about 24–80 feet per minute, or so that it effects about 150–560 needle impingements per square inch. The integral batt produced has a weight of about 10–32 ounces per square yard and can be subjected to the wet finishing operations—scouring, bleaching, finish applications, washing, steaming, and drying—with greatly simplified equipment and at increased line speeds. It is possible to add synthetic fibers during integral batt formation, but the amount of synthetic fibers should not exceed 40% by weight of the batt. Alternatively, the integral batt can be formed utilizing air laying equipment.

After wet finishing of the integral batt, it is desirable to break the integral batt back into wet-finished loose cotton fibers utilizing a conventional fiber opener. Alternatively, the finished integral batt may be taken up into a package, and the package further acted on during utilization of the cotton fibers in the manufacture of products. The wet finishing may be practiced in a conventional continuous batt bleaching range, except special conveyors, nips, and the like are not necessary since the integral batt may be readily transported and acted upon since it is in an integral form.

It is the primary object of the present invention to provide for enhanced capability to wet finish cotton or cotton blends. This and other objects of the invention will become clear from an inspection of the detailed description of the invention, and from the appended claims.

BRIEF DESCRIPTION OF THE DRAWINGS

FIG. 1 is a schematic view showing exemplary process steps that may be practiced according to the method of the present invention; and FIG. 2 is a schematic view of exemplary apparatus that may be utilized according to the present invention.

DETAILED DESCRIPTION OF THE DRAWINGS

The invention relates to a method and apparatus for the wet finishing of cotton fibers in a continuous manner. An exemplary method according to the present invention is illustrated schematically in FIG. 1.

As illustrated in FIG. 1, loose cotton fibers are provided at station 10, and may be in loose batt form. While it is desirable and possible to act upon 100% cotton fibers according to the invention, blends of cotton and synthetic fibers are also within the scope of the invention. For example from station 11 synthetic fibers (e.g. polyester, polypropylene, nylon, etc.) in percentages of about 5%, 10%, 20%, or up to about 40% by weight, may be mixed with the loose cotton fibers in stage 10.

The cotton fibers in loose batt form from stage 10 are fed to a stage 12 in which formation of an integral batt is accomplished. The integral batt that is formed has sufficient integrity to withstand further wet processing, yet remains easily transformed back into loose fibers. This formation step may be accomplished, for example, utilizing a conventional needling machine, or needle loom, sometimes called a "Fiberlocker", which has barbed needles. In an extremely fast intermittent action, the needling machine effects impingement of the needles into the loose fiber batt, causing a mingling and interlocking of the fibers to form an integral batt. The action can take place very quickly, on the order of 1500 strokes per minute. An integral batt of sufficient integrity for the practice of the invention is produced when the number of needle impingements on the loose batt is about 150–560 impingements per square inch (which may adjusted by needle speed, and depending upon needle loom design—e.g. the density of needles) and it is desirable to operate the needling machine at a linear speed of between about 24–80 feet per minute. The integral batt that is produced in stage 12 has a weight of between about 10–32 ounces per square yard.

After integral batt formation in stage 12, according to the method of the invention the integral batt of cotton fibers passes to the wet finishing stage 14. At the wet finishing stage it may be subjected to a wide variety of conventional techniques for effecting wet finishing, including scouring, washing, steaming, finish application, bleaching, and drying.

After the wet finishing stage 14, the integral batt of fibers is continuously fed to the stage 16 where the integral batt is broken back into loose cotton fibers. This is preferably accomplished utilizing a conventional fiber opener. Alternatively, under some circumstances instead of breaking the integral batt back into fibers, it may be desirable to take the integral batt up at stage 17. The package into which the integral batt has been taken up may then be further processed depending upon the products that are to be made from the cotton fiber.

Exemplary cotton fiber finishing apparatus according to the present invention is illustrated schematically in FIG. 2. The apparatus includes a cotton fiber supply 20, and optionally a synthetic fiber supply 21. Means are provided for continuously forming loose cotton fibers into an integral batt containing at least primarily cotton fibers, such forming means preferably comprising the needling machine 22 or the air laying machine 23. The needling machine 22 is known sometimes as a Fiberlocker, a Piker, or a Scutcher.

Downstream of the needling machine 22 is wet finishing means for continuously wet finishing the integral batt supplied by the integral batt forming means (needling machine) 22. The wet finishing means preferably comprises a wet finishing range 24, such as that of the conventional continuous batt type supplied by Greenville Machinery Corporation of Greenville, S.C. In the wet finishing range 24, the integral cotton batt will be subjected to whatever finishing operations are necessary for the particular cotton fibers involved, and/or the end product ultimately to be produced. It is possible, when practicing the invention, to bypass certain stages of the range 24, and the range 24 can be operated with increased line speeds and can achieve a more uniform side to side bleaching since there is less critical handling of the integral batt during processing.

After the range 24 there is provided means for continuously opening up the wet finished integral batt into loose cotton fibers. Such means preferably is a conventional fiber opener 26, such as sold under the trade name Fine Opener. Alternatively, where a particular end use or the like allows it, the treated integral batt may be taken up by conventional take-up 27, onto a package, and the package can be further processed as desired.

According to one example of the present invention, an integral cotton batt was obtained by running 100% cotton fiber through a Picker. The loose fiber batt was needled at a needle loom at about 580 strokes per minute (approximately 300 needle impingements per square inch) by the Picker to produce an integral batt having a weight of about 12 ounces per square yard. The integral batt was then processed through a conventional Greenville Machinery Corporation continuous batt wet finishing line, with excellent results in process feeding, wetting out, and uniformity of the wet finishing (e.g. bleach) process. The integral batt was then opened up into loose fibers again utilizing a conventional fiber opener, and was suitable for subsequent formation into desired products.

It will thus be apparent that according to the present invention it is possible to enhance the wet processing of cotton fibers, or blends having at least about 60% cotton fibers.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of wet finishing cotton fibers, comprising the steps of continuously, sequentially:

(a) forming a plurality of loose cotton fibers into an integral batt composed at least primarily of cotton fibers, having sufficient integrity to withstand further wet processing, yet remaining easily transformed back into loose fibers;

(b) wet finishing the integral batt including washing thereof; and (c) breaking the integral batt back into wet-finished loose cotton fibers.

2. A method as recited in claim 1 wherein step (b) is practiced by sequentially scouring, bleaching, washing, finish application, steaming and drying the cotton fibers.

3. A method as recited in claim 2 wherein step (a) is practiced so as to form an integral batt having weight in the range of 10–32 oz./yd.$^2$.

4. A method as recited in claim 2 wherein step (a) is practiced by needling cotton fibers with a needling machine, at a linear speed in the range of 24–80 ft./min.

5. A method as recited in claim 2 wherein step (c) is practiced by feeding the integral batt to a fiber opener.

6. A method as recited in claim 2 wherein step (a) is practiced by also using some synthetic fibers to form the integral batt, the amount of synthetic fibers not exceeding 40% by weight of the integral batt.

7. A method as recited in claim 1 wherein step (a) is practiced utilizing a needling machine and by operating the needling machine so that it effects in the range of 150–560 needle impingements per square inch.

8. A method as recited in claim 1 wherein step (a) is practiced so that the integral batt is substantially 100% cotton fibers.

9. A method of wet finishing cotton fibers, comprising the steps of continuously, sequentially:

(a) forming a plurality of loose cotton fibers into an integral batt having at least primarily cotton fibers, and having sufficient integrity to withstand further wet processing;

(b) wet finishing the integral batt, including by bleaching it; and (c) taking up the finished integral batt into a package.

10. A method as recited in claim 9 wherein step (a) is practiced so as to form an integral batt having weight in the range of 10–32 oz./yd.$^2$.

11. A method as recited in claim 9 wherein step (a) is practiced by needling cotton fibers with a needling machine, at a linear speed in the range of 24–80 ft./min.

12. A method as recited in claim 9 wherein step (a) is practiced by also using some synthetic fibers to form the integral batt, the amount of synthetic fibers not exceeding 40% by weight of the integral batt.

13. A method as recited in claim 9 wherein step (a) is practiced utilizing a needling machine and by operating the needling machine so that it effects in the range of 150–560 needle impingements per square inch.

14. A method as recited in claim 9 wherein step (a) is further practiced so that the integral batt is substantially 100% cotton fibers.

15. Cotton fiber finishing apparatus comprising:

(a) means for providing loose cotton fibers;

(b) means for continuously forming the loose cotton fibers into an integral batt containing at least primarily cotton fibers;

(c) wet finishing means for continuously wet finishing the integral batt supplied from said integral batt forming means including washing means; and (d) means for continuously opening up the wet-finished integral batt into loose cotton fibers.

16. Apparatus as recited in claim 15 wherein said means (b) comprises a needle loom.

17. Apparatus as recited in claim 15 wherein said means (c) comprises a wet finishing range.

18. Apparatus as recited in claim 15 wherein said means (d) comprises a fiber opener.

19. Apparatus as recited in claim 15 wherein said means (b) comprises air-laying equipment.

20. Cotton fiber finishing apparatus comprising:

(a) means for providing loose cotton fibers;

(b) means for continuously forming the loose cotton fibers into an integral batt containing at least primarily cotton fibers, including a needle loam:

(c) wet finishing means for continuously wet finishing the integral batt supplied from said integral batt forming means; and (d) means for continuously taking up the wet finished integral batt into a package for further processing thereof.

* * * * *